US008915386B2

(12) United States Patent
Limwanawong

(10) Patent No.: US 8,915,386 B2
(45) Date of Patent: Dec. 23, 2014

(54) DISPOSABLE BABY BOTTLE KIT

(75) Inventor: Amonrat Limwanawong, Chiang Rai (TH)

(73) Assignee: Asian Mos Co., Ltd., Bangkok (TH)

( * ) Notice: Subject to any disclaimer, the term of this patent is extended or adjusted under 35 U.S.C. 154(b) by 0 days.

(21) Appl. No.: 14/235,275

(22) PCT Filed: Apr. 23, 2012

(86) PCT No.: PCT/TH2012/000018

§ 371 (c)(1),
(2), (4) Date: Jan. 27, 2014

(87) PCT Pub. No.: WO2013/162481

PCT Pub. Date: Oct. 31, 2013

(65) Prior Publication Data

US 2014/0151324 A1 Jun. 5, 2014

(51) Int. Cl.

| | |
|---|---|
| ***A61J 9/08*** | (2006.01) |
| ***B65D 1/02*** | (2006.01) |
| ***A61J 9/00*** | (2006.01) |
| ***A61J 11/00*** | (2006.01) |
| ***A61J 11/04*** | (2006.01) |

(52) U.S. Cl.

CPC ..... *A61J 9/005* (2013.01); *B65D 1/0292* (2013.01); *A61J 9/008* (2013.01); *A61J 11/008* (2013.01); *A61J 11/045* (2013.01)

USPC ..... 215/11.3; 215/11.6

(58) Field of Classification Search

USPC ..... 215/201, 224, 900, 11.1–11.6; 220/315, 220/324

See application file for complete search history.

(56) References Cited

U.S. PATENT DOCUMENTS

| | | | |
|---|---|---|---|
| 2,624,485 | A | 1/1953 | Boston |
| 7,819,263 | B1 | 10/2010 | DiCarlo-Nelson |
| 2010/0193460 | A1 | 8/2010 | Driver et al. |

FOREIGN PATENT DOCUMENTS

| | | | |
|---|---|---|---|
| EP | 1714631 | A1 | 10/2006 |
| GB | 2109247 | | 6/1983 |
| GB | 2181062 | | 4/1987 |
| WO | 2008149087 | A2 | 12/2008 |

OTHER PUBLICATIONS

International Search Report and Written Opinion dated Sep. 24, 2012 in International Application No. PCT/TH2012/000018.

*Primary Examiner* — Mickey Yu
*Assistant Examiner* — Allan Stevens
(74) *Attorney, Agent, or Firm* — Kim Winston LLP

(57) ABSTRACT

A disposable baby bottle kit (10) that is easy to assemble with lowered risk of contamination of the baby bottle. The disposable baby bottle kit comprising a container that has a first portion (1) and a second portion (2), a collapsible baby bottle (3) positioned within the first portion of the container and a teat unit (4) fitted to the second portion of the container. The first portion and the second portion of the container are coupled to each other enclosing the collapsible baby bottle and the teat unit therein.

14 Claims, 11 Drawing Sheets

DISPOSABLE BABY BOTTLE KIT

CROSS-REFERENCE TO RELATED APPLICATIONS

This application is a U.S. national phase application under 35 U.S.C. §371 of International Application No. PCT/TH2012/000018 filed on Apr. 23, 2012, the entire disclosure of which is hereby incorporated by reference in its entirety.

TECHNICAL FIELD

This invention relates to a disposable baby bottle kit. More particularly, the disposable baby bottle kit of which can be assembled with reduced risk of contamination of the inside of the bottle and the teat unit.

BACKGROUND OF THE INVENTION

Pre-sterilized disposable baby bottles are known to provide a convenient way to feed the baby without having to clean the bottle before or after use. Currently known disposable baby bottles require a great deal of effort to assemble and are at risk of post-unpacking contamination of the bottle or contamination during assembling of the bottle.

EP 1 714 631 A1, disclosed a baby bottle with a teat packaged in a cup sealed with heat-sealed plastic or wax coated aluminum foil. In order to assemble the baby bottle, the user must tear off the foil which could leave behind microscopic residues of the foil elements on the edge of the open cup. Such flakes may fall into the bottle during assembly. After opening the cup, the teat is then removed and placed in possibly the user's hand or any other surface which may not be clean. The kit does not provide a clean surface for the user to rest the teat unit, in particular when the user may be in public places other than their own home. Due to the way the kit is packaged, the user must reach inside the baby bottle with their fingers in order to pull the bottle away from the cup that holds the bottle. As a result, the likely hood of contamination of the bottle with health hazardous agents is greatly increased.

In addition to the contamination problem, EP 1 714 631 A1 also has a cumbersome way of securing the teat unit to the bottle. The prior art uses a snap-fit method where leakage is common because consumers are required to press at 3 different points. Consumers who are not aware or fail to read the instruction will not seal the bottle properly. Leakage will occur.

Accordingly, there is a need for an improved disposable baby bottle kit.

SUMMARY OF THE INVENTION

The present invention discloses a disposable baby bottle kit comprising a container comprising a first portion and a second portion, a collapsible baby bottle positioned within the first portion of the container and a teat unit coupled to the second portion of the container. The first portion and the second portion of the container are coupled to each other forming a sealed capsule enclosing the collapsible baby bottle and the teat unit therein.

In one embodiment of the invention the disposable baby bottle kit comprising a container comprising a first portion and a second portion, a collapsible baby bottle positioned within the first portion of the container and a teat unit fitted to the second portion of the container. The collapsible baby bottle is placed inside the first portion and can be removed by simply tilting the first portion so that the collapsible baby bottle slides out of the first portion in order to avoid touching the sterilized interior surfaces.

In another embodiment of the invention, the disposable baby bottle kit comprising a container comprising a first portion and a second portion, a collapsible baby bottle positioned within the first portion of the container and a teat unit fitted to the second portion of the container. The collapsible baby bottle is coupled to the first portion with a snap fit mechanism or other connecting means.

The first portion is constructed to be sufficiently wide such that it allows user finger to grip on to the exterior of the bottle and remove or expand the collapsed bottle from the first portion. The collapsible baby bottle includes an opened end, a body portion and a bottom end. The open end is provided with threading for coupling with the teat unit. The collapsible baby bottle may be extended to a desired length and may be filled with liquid infant food or drink. The collapsible baby bottle is also adjustable to suit the user's grip and suitable for feeding a baby in the upright position. Although intended for single use, the kit may be reused after sterilization.

BRIEF DESCRIPTION OF THE DRAWINGS

An exemplary embodiment of the present invention is illustrated by way of example with accompanying drawings in which.

DETAILED DESCRIPTION OF PREFERRED EMBODIMENT OF THE INVENTION

Figure 1:
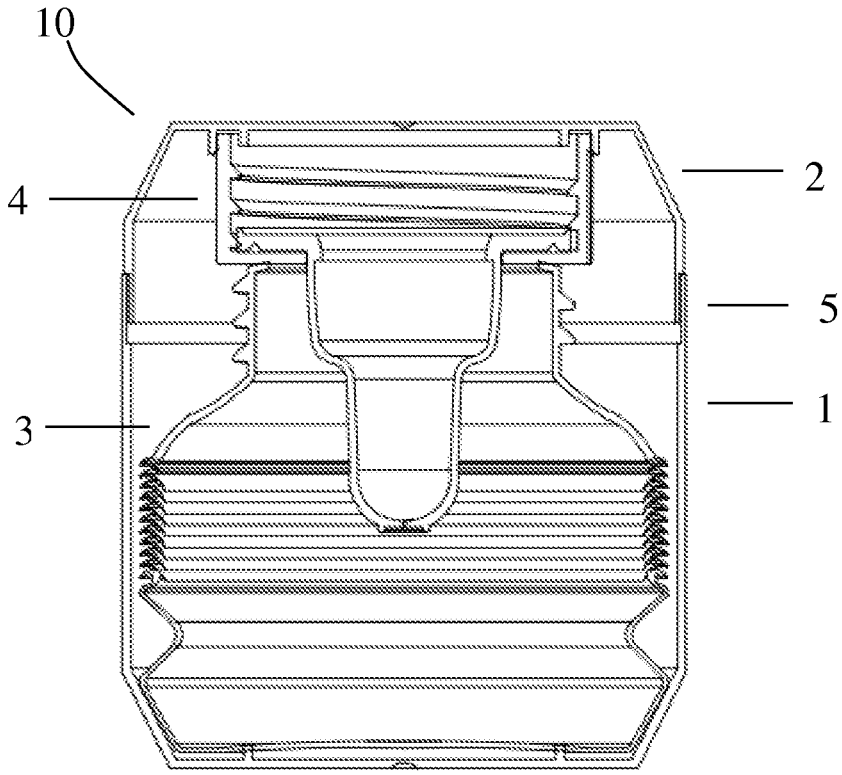
FIG. 1 illustrates a cross-section of an embodiment of the disposable baby bottle kit according to the present invention comprising a container with a first portion and a second portion and arrangement of a collapsible baby bottle and a teat unit inside the container.

FIGS. 1-13 show a disposable baby bottle kit 10 according to the principle of the invention.

According to an embodiment of the present invention, the present invention disclosed a disposable baby bottle kit 10 comprising a container comprising a first portion 1 and a second portion 2, a collapsible baby bottle 3 positioned within the first portion 1 and a teat unit 4 fitted to the second portion 2 of the container. The first portion 1 and the second portion 2 are coupled to each other forming a sealed capsule enclosing the collapsible baby bottle 3 and the teat unit 4 therein.

The first portion 1 and the second portion 2 are coupled together. The coupling mechanism can be by way of a capsule-like connection or corresponding threading or via biasing connecting web or hinge which their corresponding detail structure and characteristics will be further discussed below. The coupling may be further enhanced with plastic film wrapped around the kit of which may include instruction of use and other product information.

Figure 2:
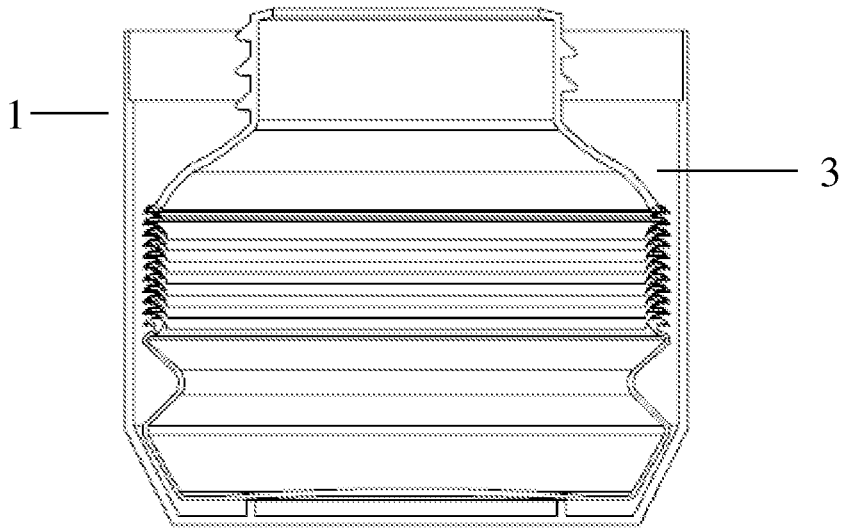
FIG. 2 illustrates a cross-section of the first portion with the collapsible baby bottle inside.
Figure 3:
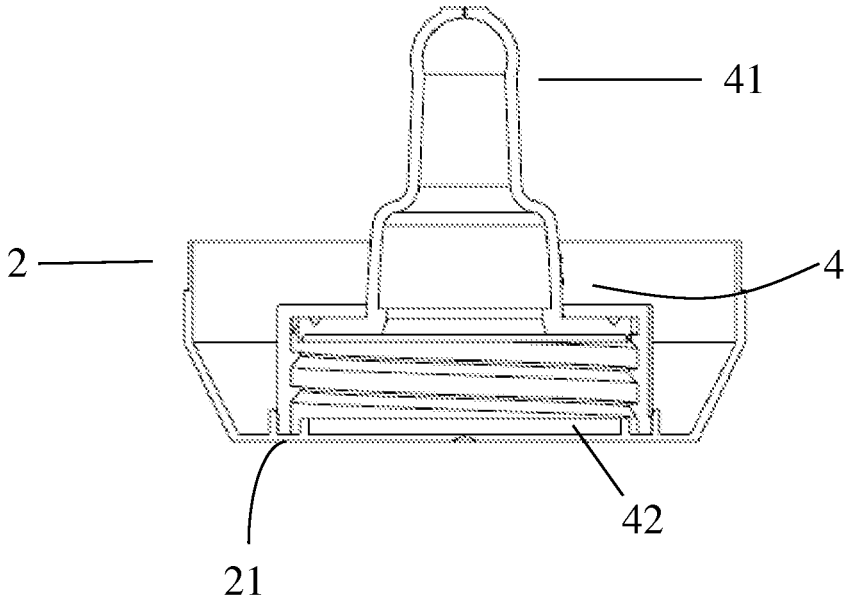
FIG. 3 illustrates the teat unit fitted to the second portion of the container wherein the teat unit includes spiral threading at a connecting end.

FIG. 1 shows an embodiment of the disposable baby bottle kit 10 according to the invention wherein the first portion 1 and the second portion 2 are coupled to each other by a capsule-like connection 5. The coupling can be separated wherein the collapsible baby bottle 3 remains inside the first portion 1 as illustrated in FIG. 2 and the teat unit 4 remains inside the second portion 2 as illustrated in FIG. 3. The capsule-like connection does not leave residues on the edge of the first portion 1 and the second portion 2 after separation unlike the heat-sealed plastic or wax coated aluminum foil. In addition, the capsule-like connection 5 is not permanently destroyed after the first portion 1 is disengaged from the second portion 2. Should the user decide to not assemble the collapsible baby bottle 3, the user can simply reconnect the second portion 2 to the first portion 1 while keeping the collapsible baby bottle 3 and the teat unit 4 clean and sterile. Once the disposable baby bottle is used, the user can also use the empty first portion 1 and second portion 2 as a secure storage capsule for other baby amenities such as soothers/pacifiers, teats/nipples or even milk powder formula.

Figure 4:
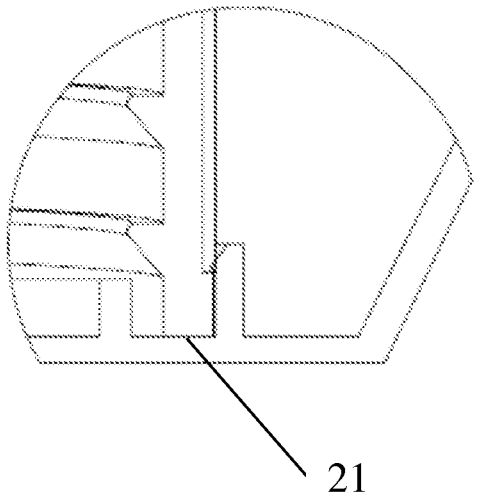
FIG. 4 illustrates an enlarged view of a groove in the second portion.

The second portion 2 includes a connecting means whereby the teat unit 4 can be engaged to and disengaged from the second portion 2. Said connecting means realized as a snap fit mechanism comprising a groove 21 situated on the internal surface of the bottom wall of the second portion 2. Said groove 21, as shown in FIG. 4, comprising two slightly spaced apart circular parallel rings of which are capable of snugly engaging to a rim of a connecting end 42 of the teat unit 4 inserted there between. The teat unit 4 includes a replaceable nipple 41 assembled to the connecting end 42 shown in FIG. 3. The connecting end 42 can accommodate any regular sized nipples. The nipple includes any regular sized nipple with characteristics generally known in the art. The connecting end 42 defines a shape corresponding to the shape of the opened end 32 of the collapsible baby bottle 3 and is configured to receive coupling of the nipple by way of coupling means as generally known in the art. The connecting end 42 also includes internal spiral threading as a connecting means for coupling the teat unit 4 to the collapsible baby bottle 3. The second portion 2 functions as a clean surface for resting of the teat unit while disassembling of the kit is in progress or while the user is preparing the formula. The user can simply put the teat unit 4 in an upright position while still connected to the second portion 2. This again will reduce the chance of contamination of the replaceable nipple 41.

Figure 5:
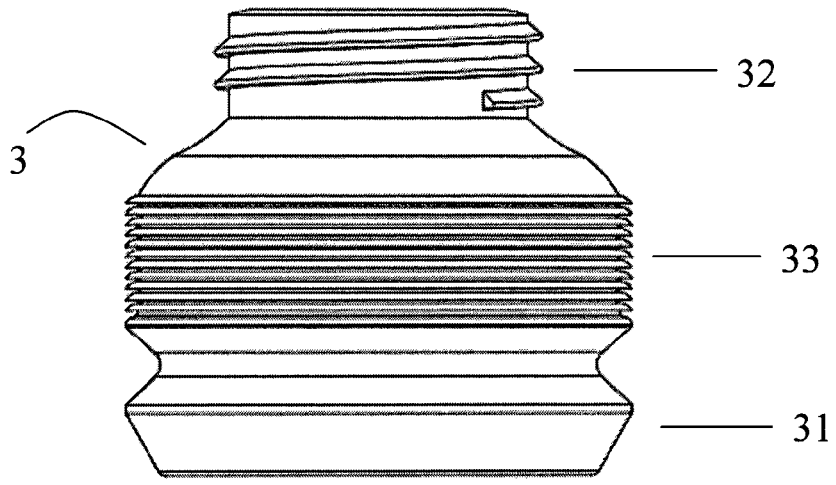
FIG. 5 illustrates a collapsible baby bottle in the collapsed position where the bottle includes an opened end, body portion, and a bottom end.

The collapsible baby bottle 3 as seen in FIG. 5 includes an opened end 32, a body portion 33 and a bottom end 31 which are integrally formed and wherein the opened end 32 includes external spiral threading for receiving coupling of the connecting end 42 of the teat unit 4.

In order to provide a more compacted disposable baby bottle kit, while the teat unit 4 remains coupled to the second portion 2, a nipple or a portion thereof is arranged to enter the inside of the collapsible baby bottle 3 as the first portion 1 is coupled to second portion 2 as shown in FIG. 1. This arrangement also reduces the cost for the manufacturing of the first portion 1 and the second portion 2 as lesser amount of material is needed.

Figure 6:
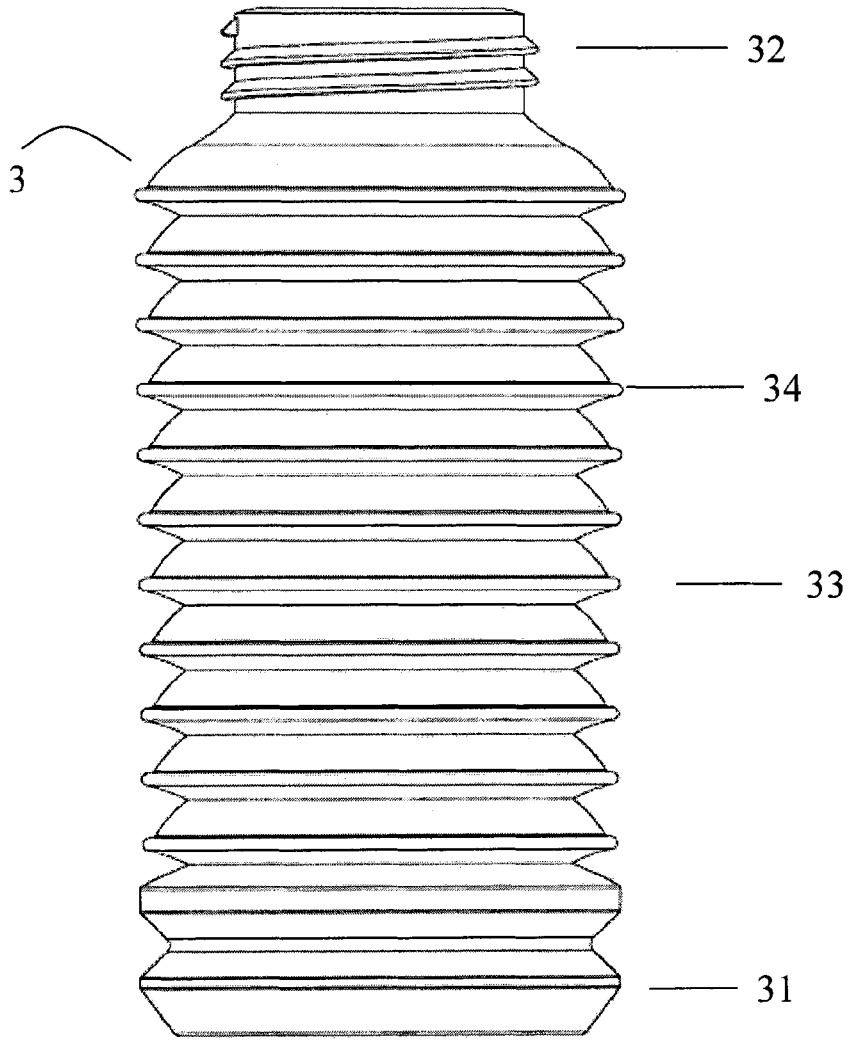
FIG. 6 illustrates an expanded collapsible baby bottle showing concentric rings on the body portion and spiral threading at the opened end.
Figure 7:
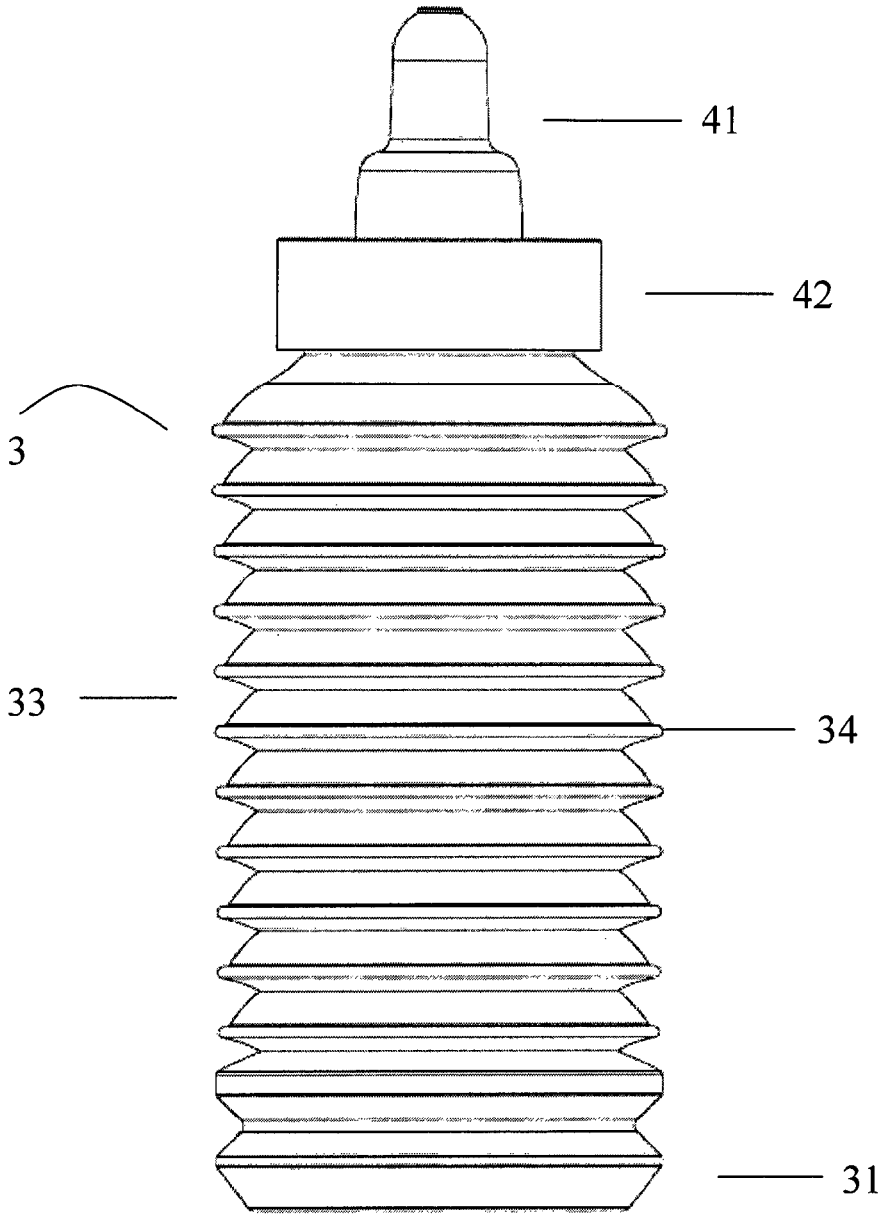
FIG. 7 illustrates the expanded collapsible baby bottle assembled to the teat unit.
Figure 8:
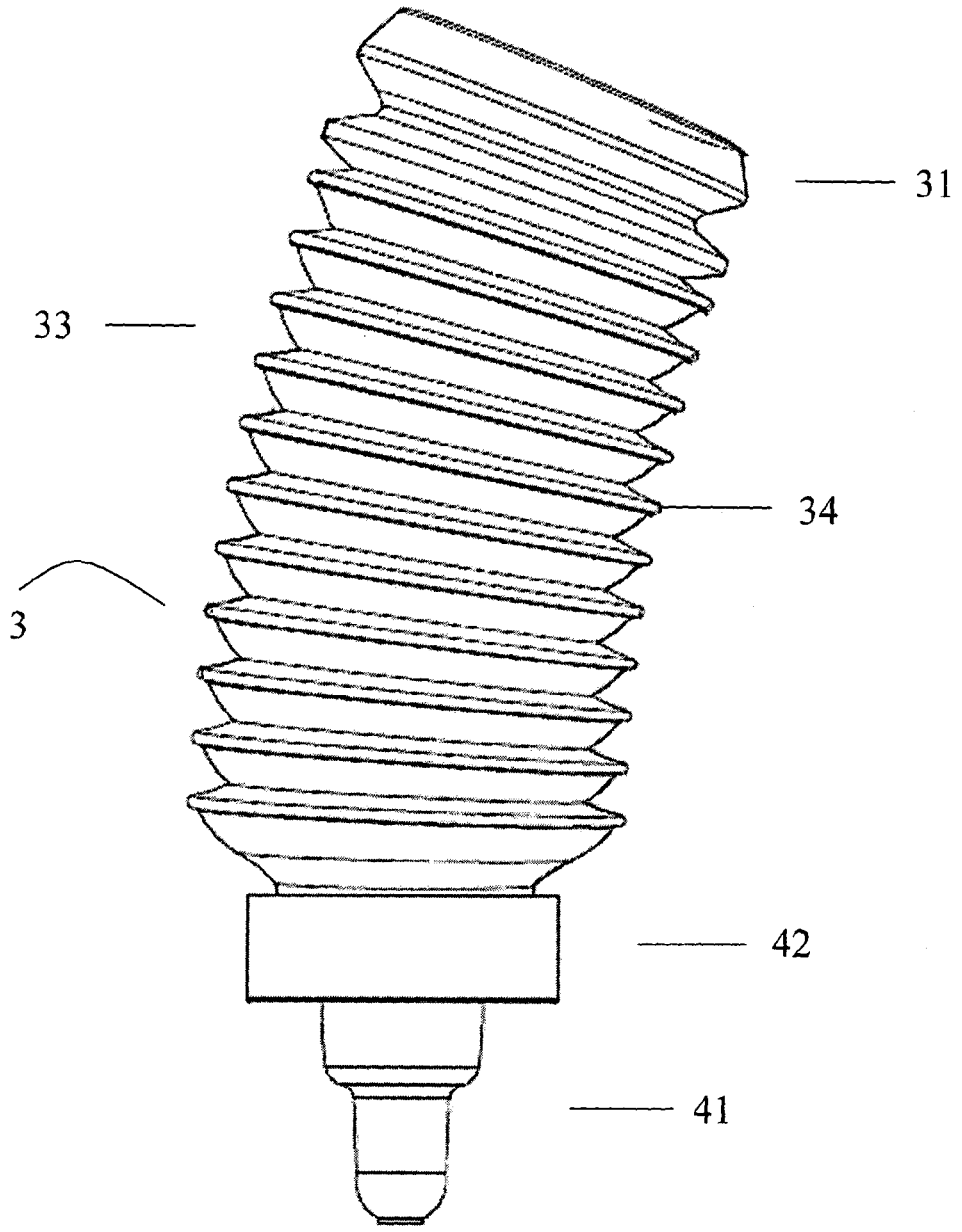
FIG. 8 illustrates the expanded collapsible baby bottle in a bended position having a teat unit assembled thereto.

As illustrated in FIG. 6, the collapsible baby bottle 3 is extendable and the body portion 33 includes multiple concentric rings 34. The concentric rings 34 eliminate spring-like resistance during the collapsing of the collapsible baby bottle 3 resulting in a more compact structure as illustrated in FIG. 5 as well as facilitate bending of the body portion 33 as illustrated in FIG. 8. The collapsible baby bottle 3 also has graduated measurements 37 on its body. This is to facilitate the user in providing the correct amount of baby formula for the baby. As an example, a fully extended collapsible baby bottle 3, shown in FIG. 7, is capable of holding up to 8 ounces of liquid. However, it is obvious to a person skilled in the art that the capacity of the collapsible baby bottle 3 may vary.

It is preferable that the opened end 32 of the collapsible baby bottle 3 is made of the same material as other parts of the collapsible baby bottle 3. The opened end 32, however, is prepared with greater wall thickness in comparison to the thickness of the body portion 33 or the bottom end 31. The thickened wall of the opened end 32 enhances rigidity of the structure to allow better connection between the opened end 32 of the collapsible baby bottle 3 and the connecting end 42 of the teat unit 4. In addition, thickened material at the opened end 32 is needed to create a uniformed thickness of the disposable baby bottle 3. During production, the disposable baby bottle undergoes a blow molding process where having a thickened material at the opened end 32 allows an even flow of material to create the disposable baby bottle 3 with uniformed wall thickness. The uniformed thickness serves to maintain the concentric rings 34 expansion to their predetermined scale to ensure a uniform and accurate volumetric capacity of each concentric ring. Hence the volume of the content to be filled into the collapsible baby bottle 3 will correspond to the graduated markings prepared on the collapsible baby bottle 3.

It is preferable that the entire collapsible baby bottle 3 is made of environmentally friendly material and is recyclable. Since the collapsible baby bottle 3 is made up of one type of material, there is less issue in separating different types of materials for recycling purposes.

Figure 9:
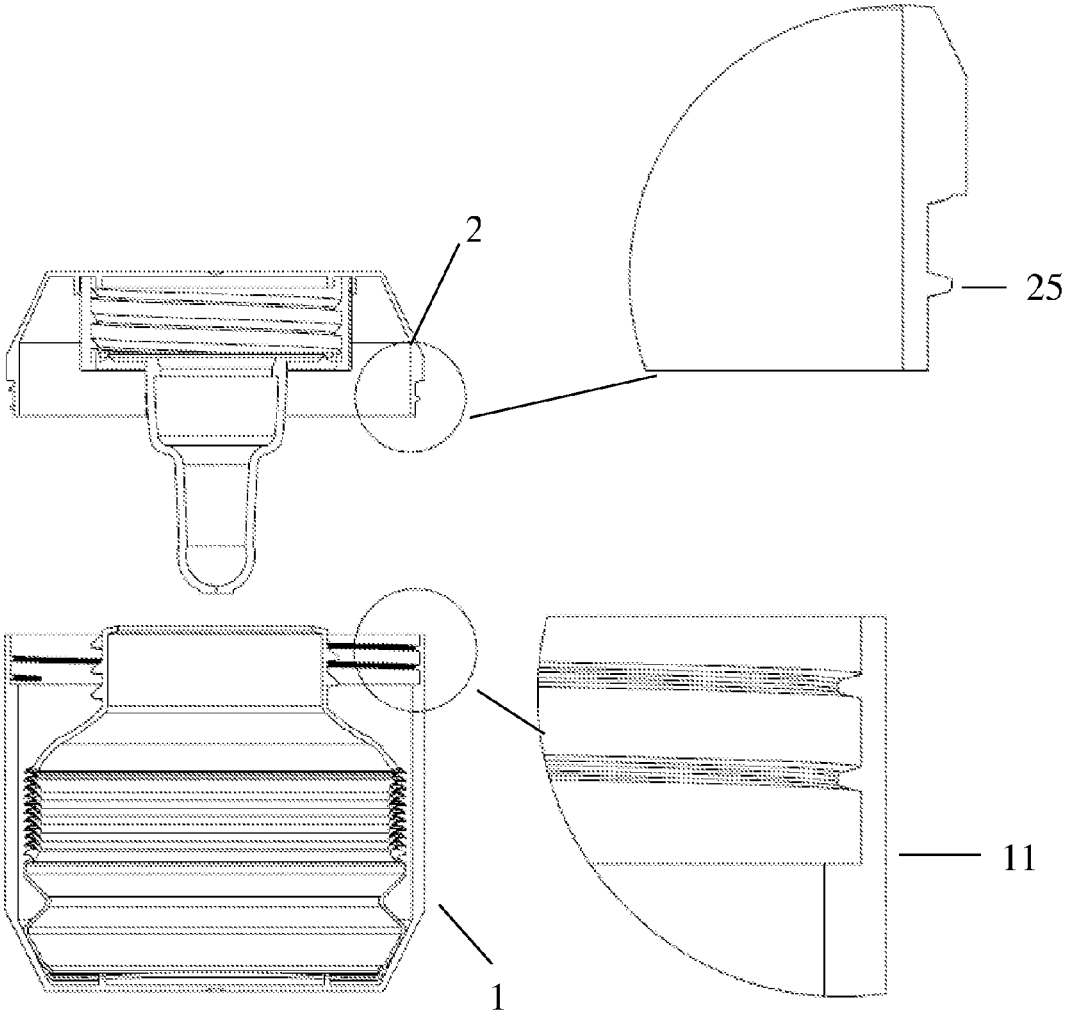
FIG. 9 illustrates an embodiment of the disposable baby bottle kit of which the first portion and the second portion coupled to each other via corresponding threading with exploded views of the corresponding threading on the said first and second portions.

A capsule-like connection between the first portion 1 and the second portion 2 in the above described embodiment may be replaced with corresponding threading wherein the first portion 1 and the second portion 2 are prepared with corresponding male 25 and female threading 11 enabling the first portion 1 and the second portion 2 to couple together as illustrated in FIG. 9.

In another embodiment, the disposable baby bottle kit 10 comprising a container comprising a first portion 1 and a second portion 2; a collapsible baby bottle 3 positioned within the first portion 1 and a teat unit 4 fitted to the second portion 2 of the container. The first portion 1 and the second portion 2 are coupled to each other forming a sealed capsule enclosing the collapsible baby bottle 3 and the teat unit 4 therein. The features and characteristics of the second portion 2, teat unit 4 and other features of the first portion 1 and the collapsible baby bottle 3 are as described in the earlier described embodiments. However, in this embodiment, the collapsible baby bottle 3 is coupled to the first portion 1. That is, in this embodiment, the bottom end 31 of the collapsible baby bottle 3 is coupled to the interior of the bottom wall 12 of the first portion 1 via connecting means prepared on the collapsible baby bottle 3 and the first portion 1.

Figure 10:
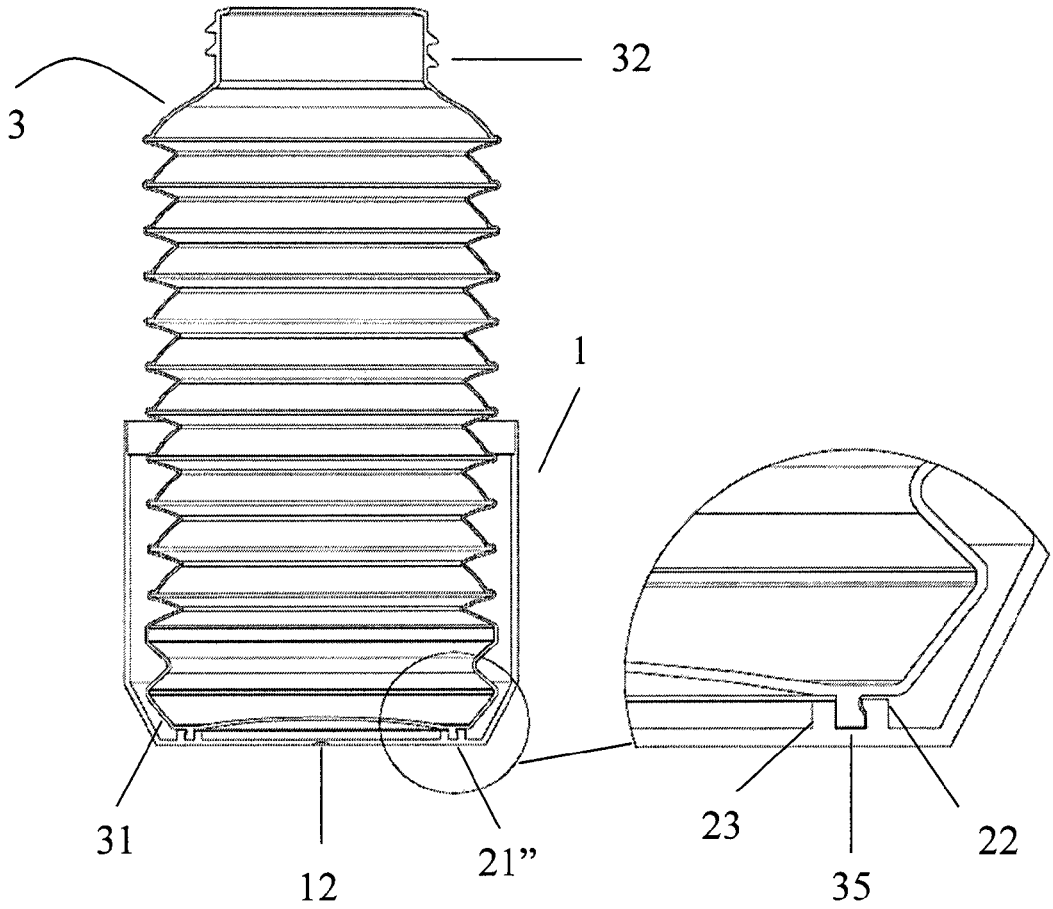
FIG. 10 illustrates an embodiment of the disposable baby bottle kit of which the collapsible baby bottle is coupled to the first portion via a pair of grooves on the bottom wall of the first portion and a ridge ring prepared on the external surface of the bottom end of the collapsible baby bottle.

As illustrated in FIG. 10, in this embodiment, the coupling between the first portion 1 and the collapsible baby bottle 3 may be a snap fit mechanism as generally known in the art or utilizing the same coupling mechanism as with the coupling of the teat unit 4 to the second portion 2 as previously described. That is, the first portion 1 includes a connecting means whereby the bottom end 31 of the collapsible baby bottle 3 can be engaged to and disengaged from the first portion 1. The said connecting means realizes a snap fit mechanism comprising a groove 21" prepared on the internal surface of the bottom wall 12 of the first portion 1 and a ridge ring 35 prepared on the external surface of the bottom end 31 of the collapsible baby bottle 3. Said groove 21" comprising preferably circular parallels comprising an outer ring 22 and an inner ring 23. The outer ring 22 and the inner ring 23 are slightly spaced apart such that the space there between is able to snugly receive engagement of the ridge ring 35 of the bottom end 31 of the collapsible baby bottle 3.

Figure 11:
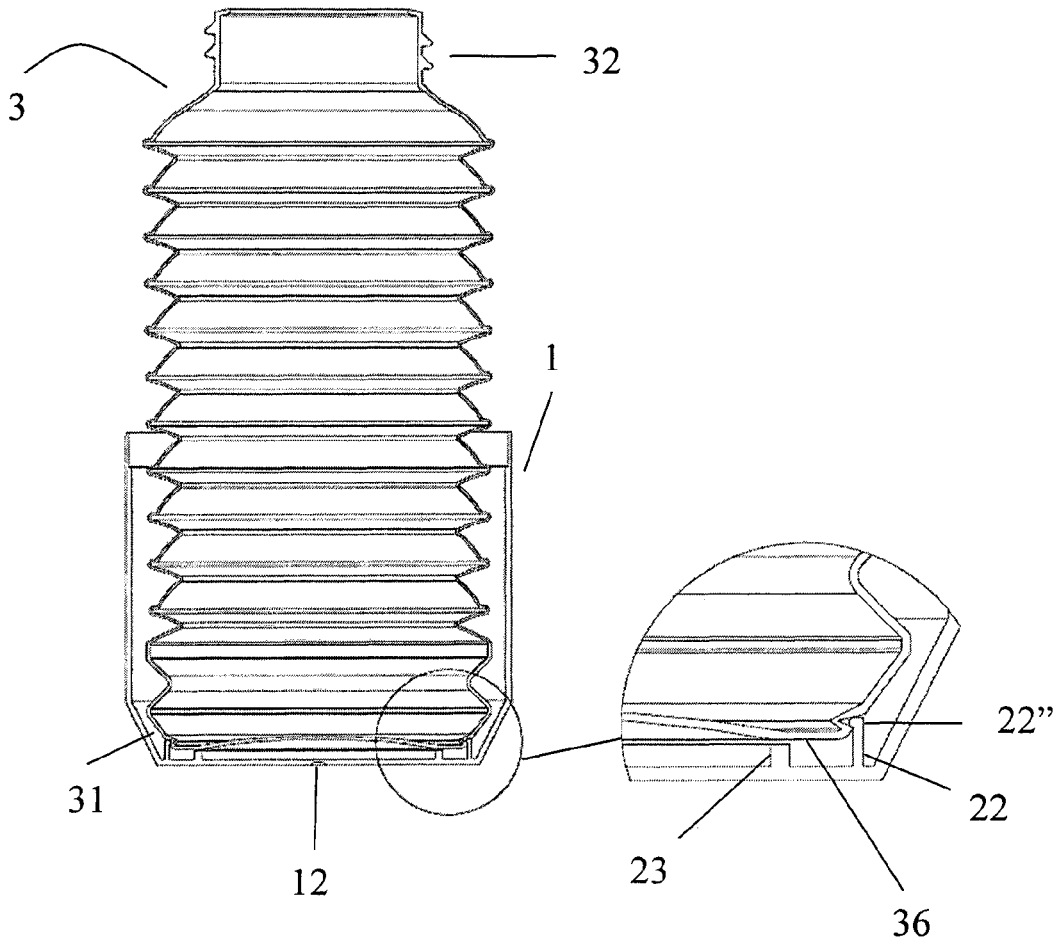
FIG. 11 illustrates an embodiment of the disposable baby bottle kit in which the collapsible baby bottle is coupled to the first portion via a pair of grooves on the bottom wall of the first portion and a latching member on the bottom region of the disposable baby bottle.

FIG. 11 shows another embodiment of the disposable baby bottle kit 10. In this embodiment, the collapsible baby bottle 3 is also coupled to the first portion 1 utilizing the same snap fit mechanism but with different coupling elements. As shown in this embodiment, the first portion 1 is prepared with a groove comprising an outer ring 22 and an inner ring 23 similar to the previously described. In this embodiment, the outer ring 22 is, however, prepared farther apart from the inner ring 23. The outer ring 22 is also slightly taller than the inner ring 23. The tip of the outer ring 22 includes a hook member 22". The said hook member 22" is capable of latching on to a latching member 36 prepared on the bottom of the collapsible baby bottle 3 securing the collapsible baby bottle 3 to the first portion 1 as the collapsible baby bottle 3 is pressed downward.

Figure 12:
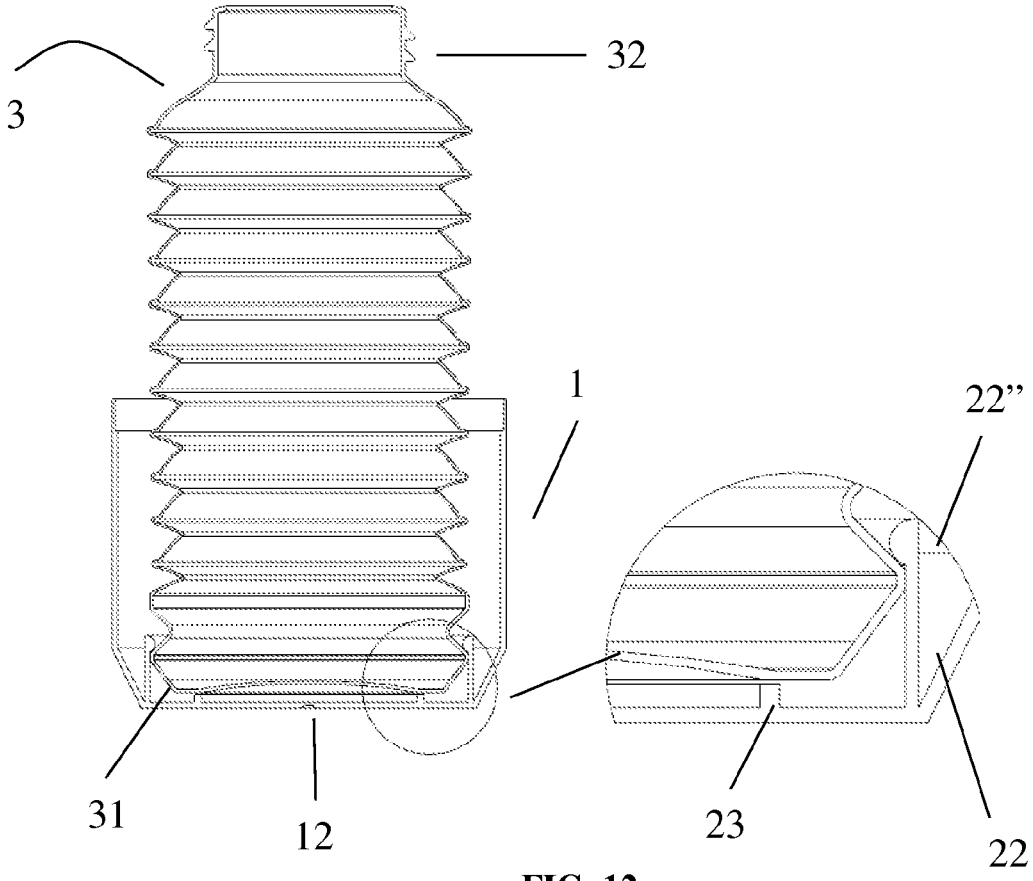
FIG. 12 illustrates an embodiment of the disposable baby bottle kit in which the collapsible baby bottle is coupled to the first portion via a pair of grooves wherein one member of the said groove is adapted to grasp onto the bottom concentric ring of the collapsible baby bottle.

FIG. 12 shows another embodiment of the disposable baby bottle kit 10. In this embodiment, the collapsible baby bottle 3 is also coupled to the first portion 1, still utilizing the same snap fit mechanism, but yet with further different coupling elements. As shown in this embodiment, the first portion 1 is prepared with a groove comprising an outer ring 22 and an inner ring 23 similar to the previously described. In this embodiment, the outer ring 22, however, is much farther spaced-apart from the inner ring 23. The outer ring 22 includes a latching member 22" at the tip as earlier described. The outer ring 22 is positioned immediately at the proximity of the circumference of the bottom end of the collapsible baby bottle 3 and extending upward beyond the first concentric ring from the bottom of the collapsible baby bottle 3 such that the latching member 22" is able to engage with the said concentric ring of the collapsible baby bottle 3 by securing the collapsible baby bottle 3 to the first portion 1.

Figure 13:
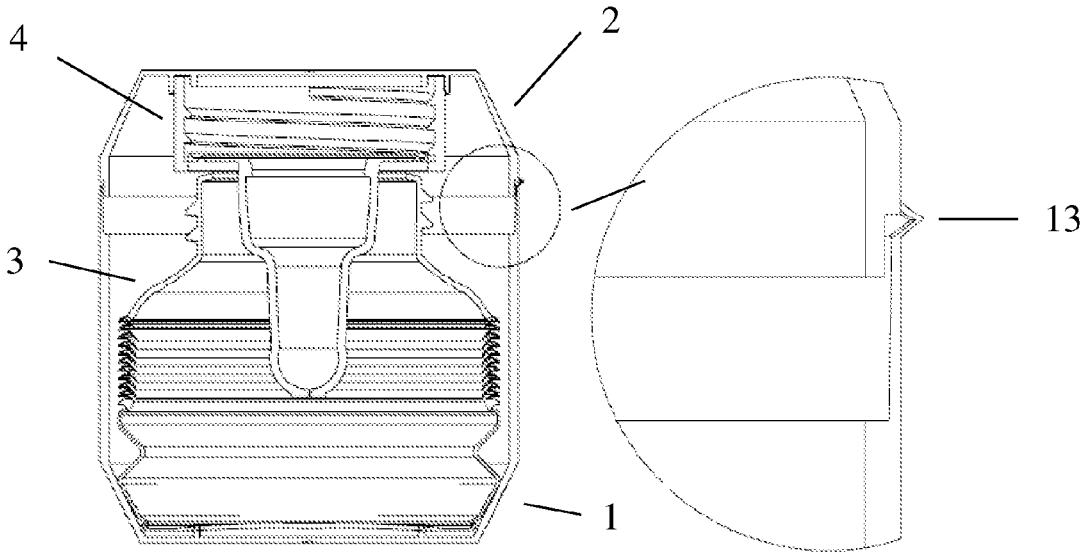
FIG. 13 illustrates an embodiment of the disposable baby bottle kit in which the first portion and the second portion is connected by a hinge.
Figure 14:
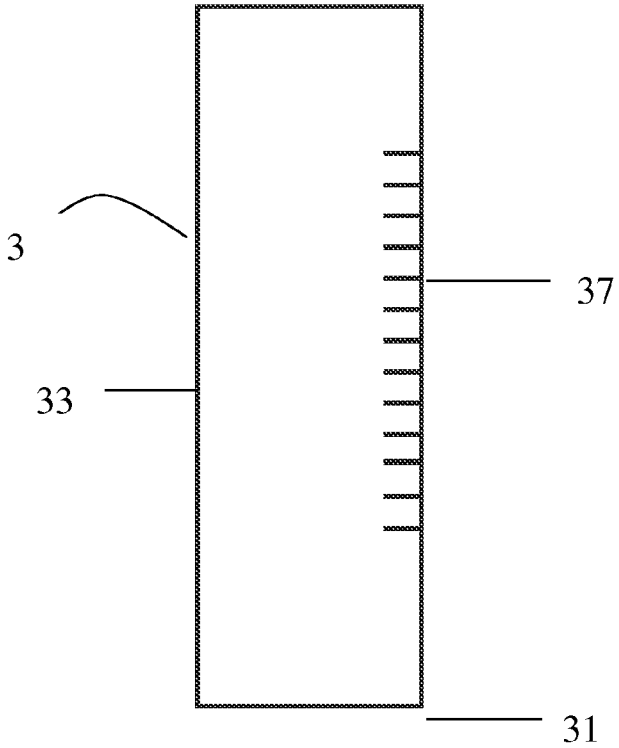
FIG. 14 illustrates an embodiment of the disposable baby bottle with graduated measurements.

In a further embodiment, the disposable baby bottle kit 3 comprising a container comprising a first portion 1 and a second portion 2, a collapsible baby bottle 3 positioned within the first portion 1 and a teat unit 4 fitted to the second portion 2 of the container. The first portion 1 and the second portion 2 are coupled to each other forming a sealed enclosure enclosing the collapsible baby bottle 3 and the teat unit 4 therein. The features and characteristics of the second portion 2, teat unit 4 and the first portion 1 and the collapsible baby bottle 3 are as described in any of the earlier described embodiments. However, in this embodiment, first portion 1 and second portion 2 remains connected via a biasing connecting web or hinge 13 or the like as illustrated in FIG. 13. The biasing connecting web or hinge is integrally formed to the first portion 1 and the second portion 2 at a predetermined location and preferably made of the same material as with the first portion 1 and the second portion 2. The biasing ability of the connecting web or hinge permits repetition opening and closing of the container. This will even further reduce the chance of contamination of the baby bottle and the teat unit 4. In the embodiment where the first portion 1 and the second portion 2 are removed completely, the teat unit 4 while maintaining on a clean surface of the second portion 2, is exposed to elements while the user is preparing a feeding bottle. In an extreme environment, the teat unit 4 could have been exposed to air-borne contaminants. With this embodiment, once the user has removed the collapsible baby bottle 3 and is in the process of preparing the feeding bottle, the user can reclose the container keeping the teat unit 4 inside the container at all times until the preparation of the feeding bottle is completed and ready to be assembled with the teat unit 4.

It is preferable that the first portion 1 and the second portion 2 are sufficiently wide to allow finger access between the opened end 32 and surrounding side wall of the first portion 1 in order to grip the exterior of the opened end 32 and disengage the collapsible baby bottle 3 from the first portion 1. Further, with this embodiment, the collapsible baby bottle 3 may be extended but remain coupled to the first portion 1 while preparation of a feeding bottle is in progress. This will provide a steadier placement of the extended collapsible baby bottle 3 while being filled with baby formula or liquid. Once the filling is completed, the first portion 1 then may be detached from the collapsible baby bottle 3.

As illustrated in FIG. 8, the collapsible baby bottle 3 facilitates bending of the bottle so that the user has a better grip of the collapsible baby bottle 3, at the same time improves flow of the liquid even if the baby is in an upright position. This configuration is beneficial to the well-being of the baby as feeding in upright position is the preferred feeding position. The upright feeding position is regarded to reduce the incidence of colic and to prevent liquid from flowing into the baby's inner ear preventing ear infection.

From the above, it is clearly illustrated that the disposable baby bottle kit 10 according to the principle of the present invention offers more conveniences and better solution against contamination.

Although the disposable baby bottle kit 10 is most suitable for single use, it is also possible to be reused. The collapsible baby bottle 3 and the connecting end 42 of the teat unit 4 can be sterilized by boiling or cleaned using a baby-bottle disinfecting solution. Since the replaceable nipple 41 is detachable the user only needs to purchase a reusable nipple and insert the same into the connecting end 42 of the teat unit 4. The replaceable nipple 41 also eases separation of different types of materials for recycling purposes. The replaceable nipple 41 that is made of one type of material can be easily separated from the connecting end 42 which is made of a different type of material. Each type of material can then be recycled separately.

The invention claimed is:

1. A disposable baby bottle kit (10), comprising:

a container;

a collapsible baby bottle position within the container; and a teat unit;

characterized in that the container comprising a first portion (1) and a second portion (2);

the collapsible baby bottle (3) comprising an opened end (32), a body portion (33) and a bottom end (31), being collapsed and positioned within the first portion (1) of the container; and the teat unit (4) coupled to the second portion (2) of the container wherein the second portion (2) comprising a connecting means realized as a snap fit mechanism comprising a groove (21); prepared on an internal surface of a bottom wall of the second portion; and is able to snugly receive engagement of a rim of a connecting end (42) of the teat unit (4) and securing the teat unit (4) thereto;

the first portion (1) and the second portion (2) are coupled to each other forming a sealed capsule enclosing the collapsible baby bottle (3) and the teat unit (4) therein.

2. The disposable baby bottle kit (10) according to claim 1, wherein the first portion (1) and the second portion (2) are coupled to each other by way of a capsule-like connection.

3. The disposable baby bottle kit (10) according to claim 1, wherein the first portion (1) and the second portion (2) are coupled to each other by way of corresponding threading prepared on the first portion (1) and the second portion (2).

4. The disposable baby bottle kit (10) according to claim 1, wherein the first portion (1) and the second portion (2) are coupled to each other by way of a biasing connecting web or hinge integrally formed on the first and second portion (1, 2).

5. The disposable baby bottle kit (10) according to claim 1, wherein said connecting means permits coupling of the teat unit (4) to the second portion (2) and allows engagement and disengagement of the teat unit (4) to or from the second portion (2).

6. The disposable baby bottle kit (10) according to claim 5, wherein the teat unit (4) includes a replaceable nipple assembled to the connecting end (42);

the connecting end (42) include an internal threading to facilitate coupling to the collapsible baby bottle (3).

7. The disposable baby bottle kit (10) according to claim 6, wherein the opened end (32), the body portion (33) and the bottom end (31) are made of the same material and are integrally connected;

wherein the body portion (33) comprising multiple concentric rings (34) permitting the body portion (33) to be collapsible and expandable and bendable; and wherein a thickness of a wall of the opened end (32) is greater than a thickness of a wall of the body portion (33) or the bottom end (31);

said opened end (32) includes external threading corresponding to internal threading prepared on the connecting end (42) of the teat unit (4) permitting coupling of the teat unit (4) to the collapsible baby bottle (3).

8. The disposable baby bottle kit (10) according to claim 5, wherein the collapsible baby bottle (3) is coupled to the first portion (1) by way of a connecting means.

9. The disposable baby bottle kit (10) according to claim 8, wherein said connecting means between the collapsible baby bottle (3) and the first portion (1) realized as a snap fit mechanism comprising a groove (21"); said groove (21") comprising two circular parallel spaced-apart outer ring (22) and inner ring (23) prepared on a bottom wall (12) of the first portion (1), and a ridge ring (35) prepared on an external surface of the bottom end (31) of the collapsible baby bottle (3);

the groove (21") on the bottom wall (12) of the first portion (1) able to snugly receive engagement of the ridge ring (35) of the bottom end (31) of the collapsible baby bottle (3) securing the collapsible baby bottle (3) to the first portion (1).

10. The disposable baby bottle kit (10) according to claim 8, wherein the connecting means realized as a snap fit mechanism comprising a groove (21");

said groove comprising two circular parallel spaced-apart outer ring (22) and inner ring (23) prepared on a bottom wall (12) of the first portion (1), the outer ring (22) includes a hook member (22"); and a latching member (36) prepared on the bottom end of the collapsible baby bottle (3); the hook member (22") of the outer ring (22) is capable of latching onto the latching member (36) on the bottom end of the collapsible baby bottle (3) securing the collapsible baby bottle (3) to the first portion (1).

11. The disposable baby bottle kit (10) according to claim 7 wherein a connecting means realized as a snap fit mechanism comprising a groove (21"); said groove (21") comprising two circular parallel spaced-apart outer ring (22) and inner ring (23) prepared on a bottom wall (12) of the first portion (1), the outer ring (22) is placed at a position in proximity to a circumference of the bottom end (31) of the collapsible baby bottle (3);

the outer ring (22) includes a hook member (22") and is capable of latching onto a first concentric ring of the multiple concentric rings (34) on the bottom end (31) of the collapsible baby bottle (3) securing the collapsible baby bottle (3) to the first portion (1).

12. The disposable baby bottle kit (10) according to claim 7, wherein each concentric ring (34) forming the body portion (33) of the collapsible baby bottle is marked with graduated measurements.

13. The disposable baby bottle kit (10) according to claim 4, wherein said connecting means permitting coupling of the teat unit (4) to said second portion (2) allows engagement and disengagement of the teat unit (4) to or from the second portion (2).

14. The disposable baby bottle kit (10) according to claim 7, wherein the collapsible baby bottle (3) is coupled to the first portion (1) by way of a connecting means.

* * * * *